United States Patent [19]

LaBate et al.

[11] Patent Number: 4,783,061

[45] Date of Patent: Nov. 8, 1988

[54] TUNDISH LINER

[75] Inventors: Michael D. LaBate, Ellwood City; Joseph A. Perri, Coraopolis, both of Pa.

[73] Assignee: Insul Company, Inc., East Palestine, Ohio

[21] Appl. No.: 61,158

[22] Filed: Jun. 12, 1987

[51] Int. Cl.[4] ..... C21C 5/44

[52] U.S. Cl. ..... 266/281; 266/286

[58] Field of Search ..... 266/275, 280, 281, 286; 264/30; 164/437, 337, 335

[56] References Cited

U.S. PATENT DOCUMENTS

| | | | |
|---|---|---|---|
| 3,203,689 | 8/1965 | Hallowell, Jr. | 266/286 |
| 3,258,510 | 6/1966 | Cullinan | 264/30 |
| 3,955,721 | 5/1976 | LaBate | 222/566 |
| 4,042,229 | 8/1977 | Eccleston | 266/275 |
| 4,194,730 | 3/1980 | Matsumoto et al. | 266/275 |
| 4,339,115 | 7/1982 | Daussan et al. | 266/280 |
| 4,372,544 | 2/1983 | LaBate | 266/281 |

*Primary Examiner*—L. Dewayne Rutledge
*Assistant Examiner*—S. Kastler
*Attorney, Agent, or Firm*—Harpman & Harpman

[57] ABSTRACT

A liner for a molten metal receiving tundish in the form of appropriately sized and shaped inserts formed of insulating and/or exothermic containing materials is assembled on a supporting frame which may be reusable or expendible and positioned in the tundish where the liner acts to fully protect the tundish interior from molten metal contact or penetration.

6 Claims, 5 Drawing Sheets

TUNDISH LINER

BACKGROUND OF THE INVENTION

1. Field of the Invention

This invention relates to tundishes which are intermediate pouring vessels into which the molten metal from a tapping ladle is poured and from which steel may be poured into molds or a continuous caster from one or more nozzles in the vessel and more particularly to the liner in the tundish.

2. Description of the Prior Art

Prior structures are the typically conventional tundishes formed as an open top metal box with a refractory brick lining and the newer tundishes wherein a liner in the form of appropriately sized and shaped inserts formed of insulating and/or exothermic containing materials replaces the usual brick lining or may be installed thereover. This invention provides an apparatus including a support frame on which preformed inserts of suitable material are assembled and held and subsequentally positioned directly in a tundish.

SUMMARY OF THE INVENTION

Liners for tundishes in the form of expendible inserts of consumable material and/or refractory material are assembled on or in a support frame of a configuration enabling the assembled inserts thereon to conform to the size and shape of a desired liner for a tundish. The assembled inserts including wall and bottom portions on the support frame and the fastening means securing the same to one another may be easily and rapidly lifted from the point of assembly, moved to a tundish awaiting relining and deposited therein.

In one form of the invention, the fastening means positioning the inserts and sections of the tundish lining on the support frame are released or removed and the frame lifted out of the tundish leaving the assembled lining in properly installed position in the tundish.

In another form of the invention, an expendible support frame remains attached to the preformed inserts or portions of the liner in the tundish and in still another form of the invention, the support frame engages only the top portions of the assembled preformed inserts which in turn are attached to one another so as to support the portions thereof forming the bottom boards, etc., the top support frame being either removable or expendible as desired.

DESCRIPTION OF THE PREFERRED EMBODIMENT

Figure 1:
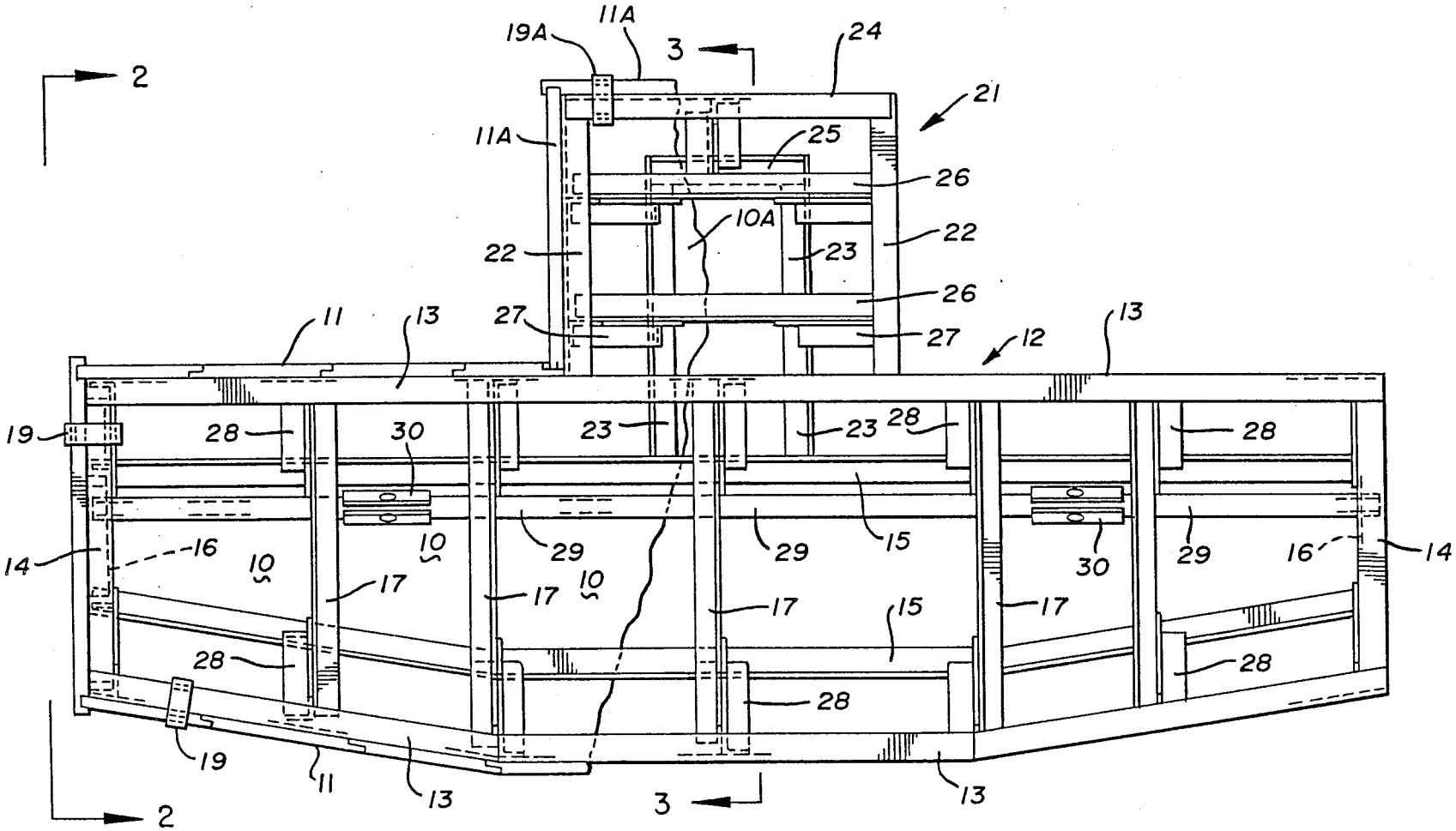
FIG. 1 is a top plan view of a support frame illustrating several preformed inserts of a tundish liner attached thereto.
Figure 8:
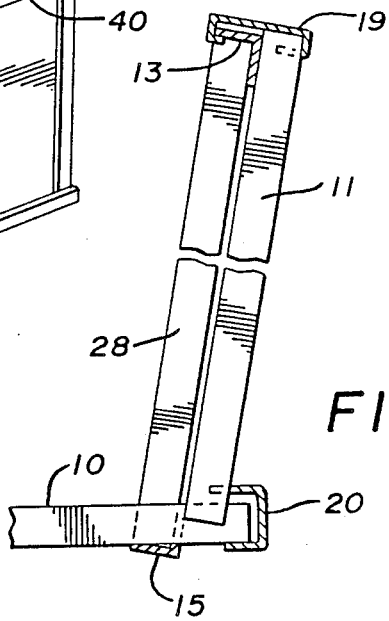
FIG. 8 is a vertical section on line 8—8 of FIG. 6.

By referring to FIG. 1 of the drawings, it will be seen that a top plan view of a partially assembled tundish liner and apparatus for inserting the same in a tundish is illustrated, the partially assembled tundish liner comprising a plurality of horizontally disposed appropriately shaped bottom portions 10 and a plurality of upstanding side portions 11, all of which are attached to apparatus for holding them in assembled relation so that they can be positioned into a tundish through the open top thereof. The apparatus supporting the bottom portions 10 and side portions 11 comprises a main frame 12 of modified rectangular shape including elongated top frame members 13, top end frame members 14, elongated bottom frame members 15, and bottom end frame members 16. The top frame members 13 are joined by transversely positioned upper cross members 17 and the bottom frame members 15 are joined by traversely positioned lower cross members 18 as may best be seen by referring to FIG. 3 of the drawings. The plurality of upper cross members 17 and the plurality of lower cross members 18 are spaced longitudinally with respect to one another and all of the frame members are preferably formed of lightweight steel angles welded to one another at their points of engagement to form a rigid structure to which the plurality of preformed inserts forming the bottom panels 10 and the upstanding side panels 11 are temporarily attached by means of a plurality of metal clips 19 and 20 as best seen in FIG. 8 of the drawings.

Still referring to FIG. 1 of the drawings, it will be seen that a sideward extension 21 on the main frame 12 of the apparatus forms an area communicating with the area defined by the main frame 12 and is comprised of upper extension frame members 22 and lower frame members 23 extending perpendicularly from the main frame members 13 and 15 on one side of the main frame 12, the upper and lower extending frame members 22 and 23 being joined at their outermost ends by secondary end frame members 24 and 25 welded thereto. An additional bottom portion 10A is positioned on the lower extended frame members 23 and the end frame 25 and additional upstanding side portions 11A are temporarily attached to the frame members 22, 23, 24 and 25 and temporarily attached thereto by additional clips 19A. The sideward extension 21 includes a pair of transversely positioned cross members 26 and several upstanding frame members 27 to lend rigidity to the sideward extension 21 of the apparatus.

Still referring to FIG. 1 of the drawings, the elongated top frame members 13 and elongated bottom frame members 15 will be seen to be connected by a plurality of upstanding frame members 28 secured at their upper and lower ends to the top frame members 13 and bottom frame members 15 to add additional rigidity to the apparatus. An elongated tubular support 29 is positioned in the apparatus immediately beneath and attached to the upper cross members 17 and the upper end frame members 14 in a location wherein half of the mass of the apparatus is on each side of the elongated tubular support 29. Upstanding apertured brackets 30 are attached to the elongated tubular support 29 and extend upwardly above the main frame 12 so that lifting means can be temporarily attached to the apparatus for lifting it and the assembled preformed liner portions as necessary in placing the same in a tundish into which the bottom liner and upstanding liner portions of the tundish are to be placed.

Figure 6:
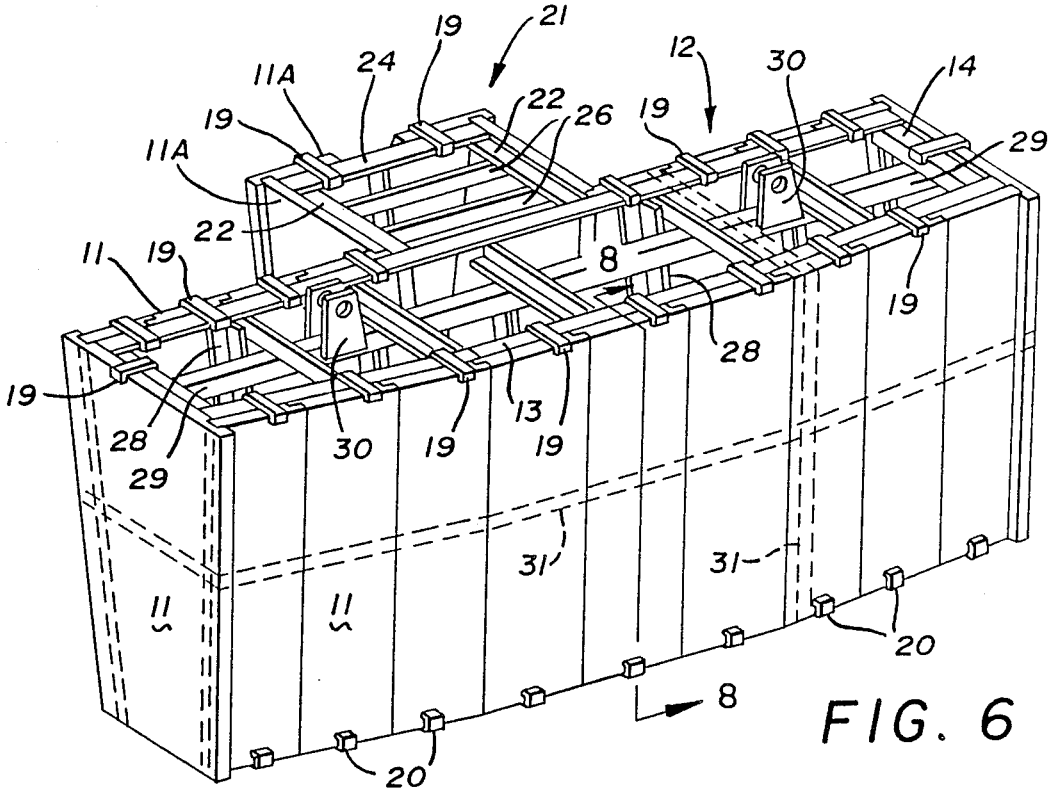
FIG. 6 is a perspective view of a plurality of inserts assembled in tundish liner form on a support frame.

In FIG. 6 of the drawings, a perspective view illustrates the apparatus including the main frame 12, the sideward extension 21 thereon and the plurality of preformed liner inserts 11 attached thereto and it will be observed that the plurality of metal clips 19 temporarily hold the several pre-formed inserts 11 or portions forming the liner for the tundish thereon. When the apparatus and the assembled liner portions as seen in FIG. 6 of the drawings are lowered into a tundish prepared to accept the same, the metal clips 19 are removed and the apparatus comprising the main frame 12 with its sideward extension 21 is lifted out of the tundish leaving the liner portions properly installed in the tundish.

By referring to U.S. Pat. No. 3,955,721, which issued to one of the present inventors in 1976, a tundish representative of the types used at that time in the steel industry may be seen and it will be observed that the tundish comprises a metal vessel 10 with a first refractory brick lining 17 in which have been positioned a plurality of appropriately sized and shaped inserts 21, 23, 24, 25 and 26 formed of insulating and/or exothermic containing materials which form an expendible tundish liner and it will be seen that the present invention eliminates the time consuming task of placing the inserts in the tundish as believed heretofore necessary.

Those skilled in the art will observe that a tundish having an eroded liner may be simply picked up by suitable lifting means turned over and dropped on a rigid surface whereupon the eroded liner will fall free of the metal vessel of the tundish. The metal vessel is then turned upright and the apparatus of the present invention, including the plurality of preformed tundish liner inserts or panels lowered therein and the liner portions released as hereinbefore described.

Figure 2:
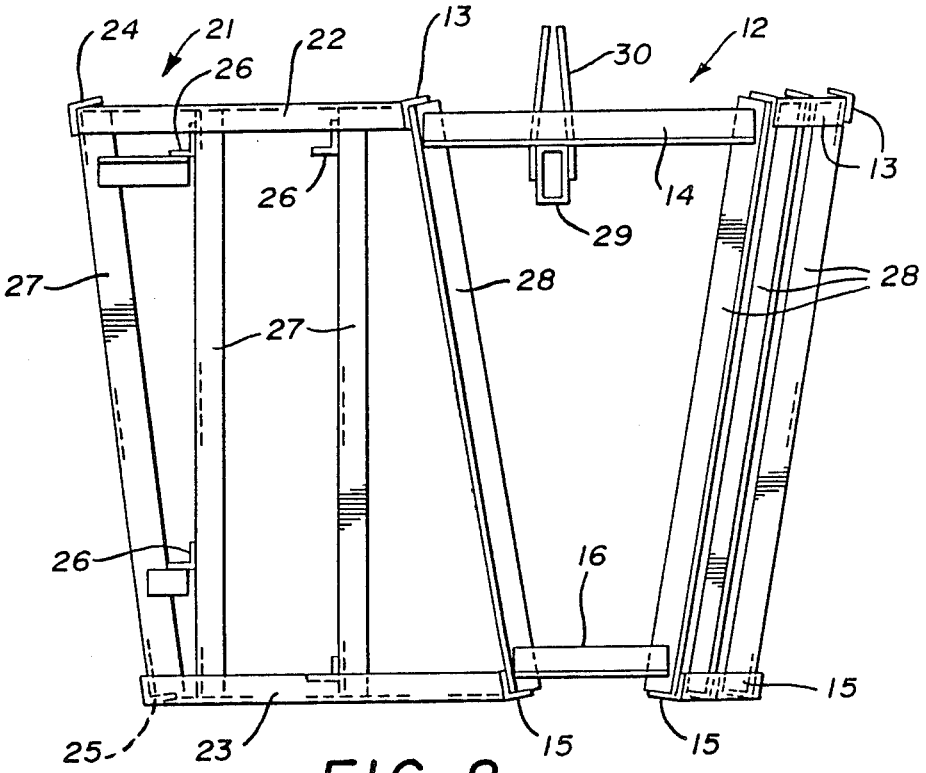
FIG. 2 is an end elevation of the left end of the support frame of FIG. 1.

In FIG. 2 of the drawings, a plan view of the left end of the apparatus illustrated in FIG. 1 of the drawings may be seen with the bottom inserts or panels 10 and 10A and the upstanding inserts or panels 11 and 11A removed to illustrate the structure of the main frame 12 and sideward extension 21 thereof.

Figure 3:
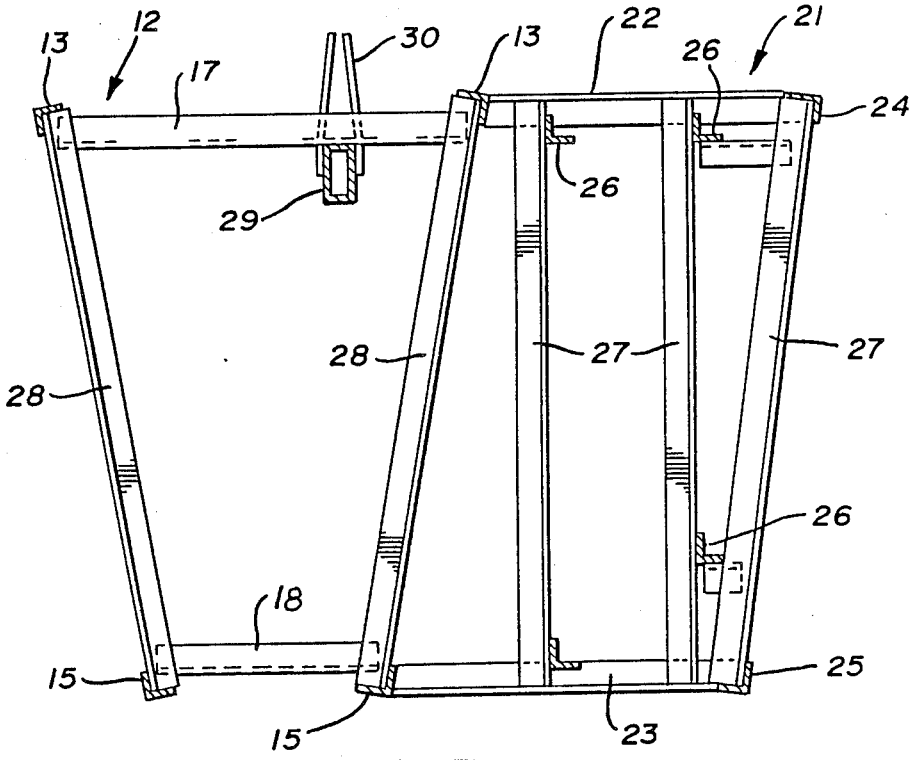
FIG. 3 is a vertical section on line 3—3 of FIG. 1.
Figure 4:
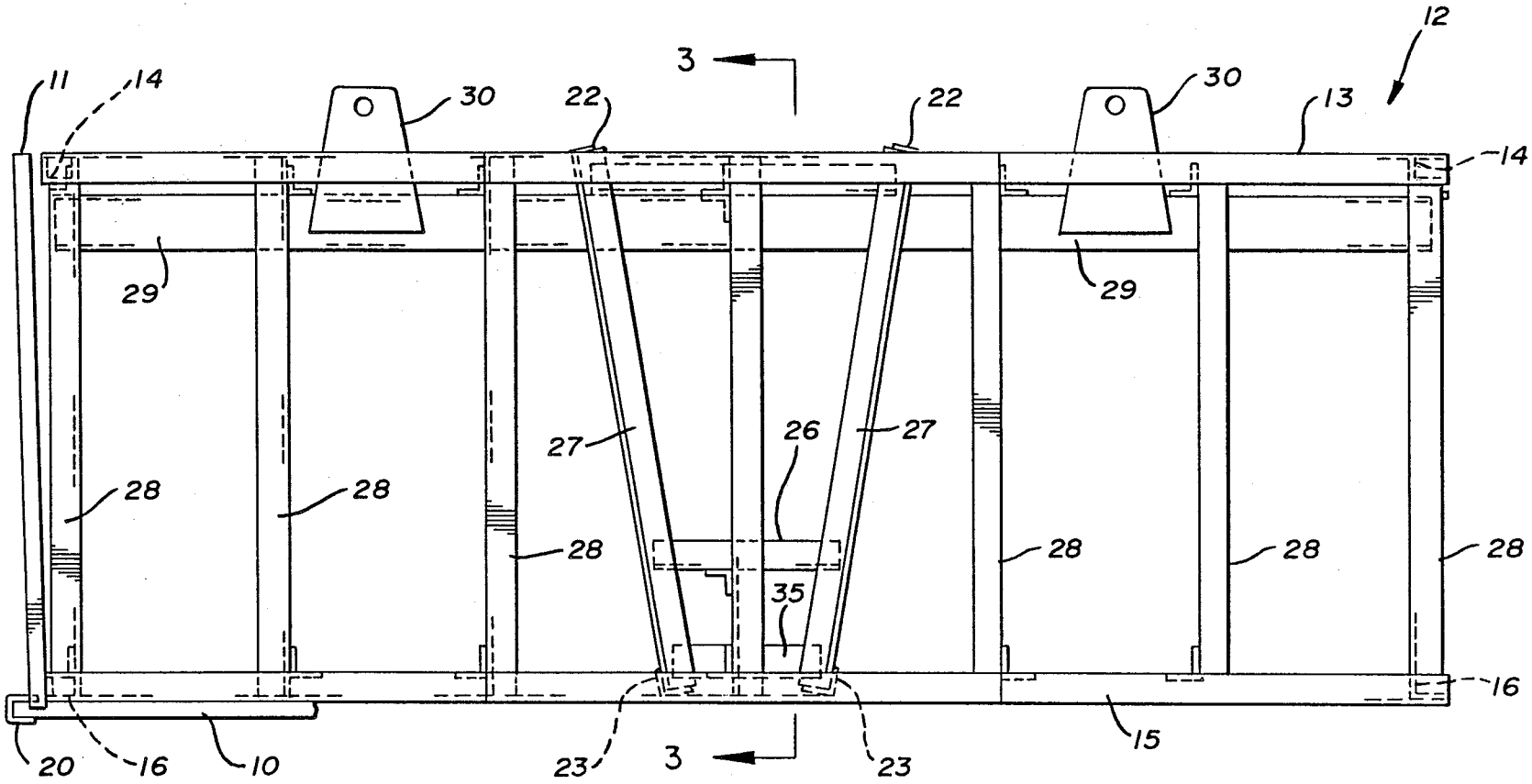
FIG. 4 is a front elevation of the support frame of FIG. 1.

In FIG. 3 of the drawings, a vertical section on line 3—3 of FIG. 1 or FIG. 4 of the drawings may be seen to illustrate the structure of the apparatus which serves to carry the pre-shaped inserts or panels as hereinbefore described.

In FIG. 4 of the drawings, a front plan of the apparatus of FIG. 1 may be seen with one of the bottom inserts or panels 10 in position thereon and one of the upstanding inserts or panels 11 thereon. It will be observed that one of the metal clips 20 is shown illustrating the manner in which the bottom panels 10 may be held in the assembly. It will be understood that a plurality of the clips 20 are used although an alternate means of holding the inserts or panels on the apparatus may comprise steel strapping positioned horizontally around the upstanding panels 11 as well as in encircling relation on a vertical plane, it being understood that the metal clips and/or the steel strapping are removed when the apparatus has positioned the inserts or panels forming the liner in the tundish being lined.

By referring now to FIG. 6 of the drawings, it will be seen that the metal clips 19 and 20 are illustrated as well as continuous metal strapping bands 31 in vertically and horizontally disposed encircling configurations, either of which devices will adequately hold the preformed inserts or panels forming the liner of the tundish to the apparatus disclosed.

Figure 5:
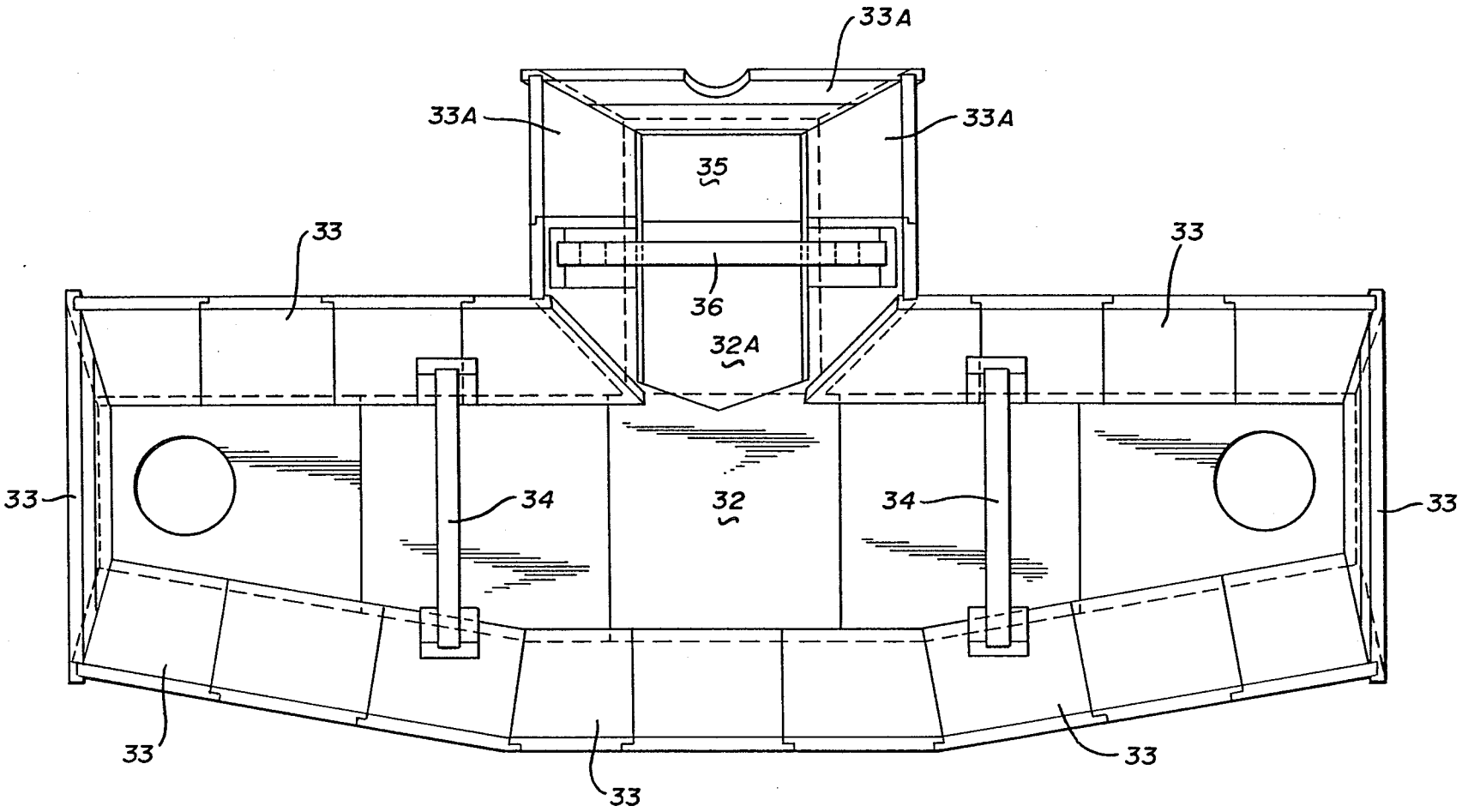
FIG. 5 is a top plan view of a plurality of expendible inserts assembled in tundish liner form.

Those skilled in the art will observe that an alternate form of the invention is possible and by referring to FIG. 5 of the drawings, it will be seen that an assembly of preformed properly shaped bottom inserts 32 and upstanding side wall inserts 33 may be assembled to one another with a pair of transverse dams 34 positioned across the main elongated assembly of the inserts and secured thereto along with a sideward extension formed by appropriately shaped preformed inserts 33A and a bottom insert 32A on which an impact pad 35 is positioned. A transversely positioned weir 37 joined at its ends to the upstanding inserts 33A and the sideward extension thus formed is attached to the upstanding inserts 33 forming the side panels of the lining for the tundish. The several inserts 32, 33, 34, 32A and 33A are secured together in the assembly illustrated in FIG. 5 by metal clips as hereinbefore illustrated and described and/or metal or similar tension strapping such as hereinbefore described. The assembled unit may be lifted by suitable means and positioned in a tundish to be lined, it being observed that the transverse dams 34 and the weir 36 provide suitable points of attachment for the lifting means, adhesive joining may also be used.

Figure 7:
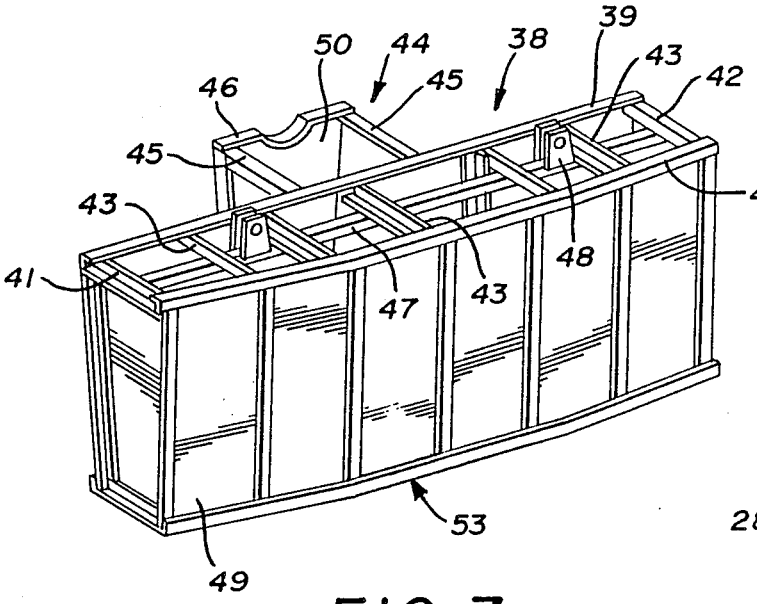
FIG. 7 is a perspective view of a modified apparatus.

A further modification of the invention disclosed herein is possible and by referring to FIG. 7 of the drawings, such a modification may be seen. In FIG. 7, a perspective view of relatively reduced size illustrates a lifting frame 38 which may be formed on a horizontal plane and includes front and back longitudinally extending frame members 39 and 40 respectively joined by end frame members 41 and 42 respectively and having several transversely positioned cross frame members 43 positioned therebetween. A sideward extension 44 comprises a pair of perpendicular frame members 45 and an end frame member 46, the inner ends of the frame members 45 being attached to the longitudinal frame member 39. An elongated tubular support 47 is attached to the end frame members 41 and 42 and is positioned below and attached to the transverse cross frame members 43 and is provided with a pair of apertured brackets 48 by which the device can be lifted by suitable lifting means, not shown. The preformed inserts 49 which, like the others disclosed herein, are preferably formed of combustible material having a predetermined rate of consumability sufficiently long to complete a pour of molten metal are attached to this simplified frame 38, the upstanding inserts being identified by the numeral 49 and those surrounding the sideward extension being identified by the numerals 50. The frame 38 may have bottom sections 53 joined by suitable uprights as shown so that the preformed inserts 49 will be supported thereby when positioned therein. The frame 38 is preferably formed of lightweight metal and is expendible by being left in the tundish with the assembled inserts therein forming the liner of the tundish.

It will thus be seen that three forms of the invention have been disclosed, namely the main frame 12 and its sideward extension 21 of FIGS. 1,2,3,4 and 6 of the drawings, the assembly of preformed inserts secured to one another and incorporating the transverse dams 34 and weir 36 defining a first modification in which no support frame reusable or expendible is needed and the second modification wherein only a lightweight horizontally disposed frame 38 as seen in FIG. 7 is used to assist in holding the preformed inserts of the liner material in suitable assembly for positioning in the tundish being lined.

It will also be seen that the apparatus forming the main frame 12 may be lightweight metal and expendible and the preformed inserts 10 and 11 simply assembled to the frame 12 in attached or unattached relation. The assembly thus formed is then placed in the tundish to be relined and the frame 12 left in place inside the inserts forming the lining of the tundish.

Those skilled in the art will observe that the preassembly of the tundish liner forming inserts as disclosed herein, greatly reduces the time and labor heretofore believed necessary in relining tundishes, blast furnace troughs and the like and enables the tundish to be lined with the highly desirable inserts of desired size formed of combustible material having a predetermined rate of consumability sufficiently long to complete a pour of molten metal in the tundish.

Having thus described my invention, what I claim is:

1. A liner for a tundish for handling hot metal comprising a support frame in a configuration insertable into said tundish and extending throughout the tundish and a plurality of planar preformed inserts of combustible material positioned on said support frame so as to be held and supported in a configuration matching said support frame, said support frame having an elongated support member positioned longitudinally thereof and means on said elongated member for engagement with lifting means.

2. The liner of claim 1 wherein said support frame comprises a plurality of metal members assembled to one another to form spaced supports for said plurality of planar preformed inserts, said planar preformed inserts being of known sizes whereby said spaced supports register with said abutting planar preformed inserts.

3. The liner of claim 2 wherein some of said assembled metal members form a sideward extension in a configuration registrable in a sideward extension of a tundish.

4. The liner of claim 1 wherein said support frame has planar upper and lower portions spaced vertically and a plurality of metal members positioned therebetween and thereacross so as to impart rigidity to said support frame and the plurality of planar preformed inserts of combustible material positioned thereon.

5. The liner of claim 4 wherein sideward frame extensions are formed on said upper and lower portions of said support frame.

6. The liner of claim 4 wherein some of said plurality of planar preformed inserts are shaped to register with said lower portion of said support frame to form a bottom of said tundish liner and others are shaped to register with said metal members positioned between said upper and lower portions of said support frame to form side walls of said tundish liner.

* * * * *